US005797666A

United States Patent [19]

Park

[11] Patent Number: 5,797,666

[45] Date of Patent: Aug. 25, 1998

[54] DESK WITH LIFTABLE MONITOR CASE

[76] Inventor: Kwang-soo Park, 317-22, Kalhyon-dong, Unp'yong-gu, Seoul, Rep. of Korea

[21] Appl. No.: 706,716

[22] Filed: Sep. 6, 1996

[51] Int. Cl.[6] ..... A47B 88/00

[52] U.S. Cl. ..... 312/319.5; 312/223.3; 312/312

[58] Field of Search ..... 312/319.5, 319.7, 312/312, 271, 223.3, 208.5

[56] References Cited

U.S. PATENT DOCUMENTS

| | | | |
|---|---|---|---|
| 2,575,725 | 11/1951 | McKay | 312/312 |
| 2,861,857 | 11/1958 | Lee | 312/312 |
| 4,669,789 | 6/1987 | Pemberton | 312/223.3 |
| 5,242,217 | 9/1993 | Gonnet | 312/312 |

FOREIGN PATENT DOCUMENTS

| | | | |
|---|---|---|---|
| 4200965 | 7/1992 | Germany | 312/223.3 |

*Primary Examiner*—Peter M. Cuomo
*Assistant Examiner*—Gerald A. Anderson
*Attorney, Agent, or Firm*—Birch, Stewart, Kolasch & Birch, LLP

[57] ABSTRACT

A desk selectively used as a reading or computer desk is disclosed. The desk has a liftable monitor case that is movably received in the desk and selectively moves in vertical direction between monitor visible and nonvisible positions. In order to vertically move the above monitor case between the two positions, the desk according to an embodiment has an automatic case lifting device including a motor-driven pantographic link work. In the case lifting device, a movable nut along with a contact bracket engages with the output shaft of a reversible motor and horizontally reciprocates along the shaft by the rotating force of the shaft. The contact bracket horizontally moves between two positions where the bracket comes into contact with limit switches, respectively, to stop the motor. The reversible motor starts to extend or retract the link work when the keyboard drawer is fully drawn out or closed.

5 Claims, 8 Drawing Sheets

DESK WITH LIFTABLE MONITOR CASE

BACKGROUND OF THE INVENTION

1. Field of the Invention

The present invention relates in general to a desk with a monitor case and, more particularly, to a structural improvement in such a desk for automatically moving the monitor case in a vertical direction so as to put the monitor in visible or nonvisible positions, thus allowing the desk to be selectively used as a reading or computer desk.

2. Description of the Prior Art

Typical computer desks must be specifically constructed to hold monitors, computers, keyboards and accessories, so that the typical computer desks are inconvenient to users when they are used as reading desks. In this regard, offices are typically equipped with computer desks and reading desks, separately, so that the spatial efficiency of the offices is reduced. Such separate equipment of computer and reading desks inside offices also increase the management cost of the offices.

In addition, the monitors, keyboards and the like may be badly affected by dust and thereby break down when they are always left outside the desk.

In an office equipped with the typical computer and reading desks separately, workers must repeatedly come and go between the two types of desks, so that the work efficiency in the office is regrettably reduced.

SUMMARY OF THE INVENTION

It is, therefore, an object of the present invention to provide a structurally-improved desk in which the problems caused by the typical computer desks can be overcome and which is provided with a liftable monitor case that is movably received in the desk and selectively moves in a vertical direction so as to put the monitor in a visible or nonvisible position, thus allowing the desk to be selectively used as a reading or computer desk.

In order to accomplish the above object, a desk in accordance with a preferred embodiment of the present invention is provided with a liftable monitor case which is movably received in the desk and automatically and selectively moves in a vertical direction so as to put the monitor in a visible or nonvisible position. In order to vertically move the above monitor case between the two positions, the desk is also provided with an automatic case lifting means.

In accordance with the primary embodiment, the case lifting means comprises a motor-driven pantographic link work.

In accordance with a second embodiment, the case lifting means comprises one pulley block.

In accordance with a third embodiment, the case lifting means comprises two pulley block.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
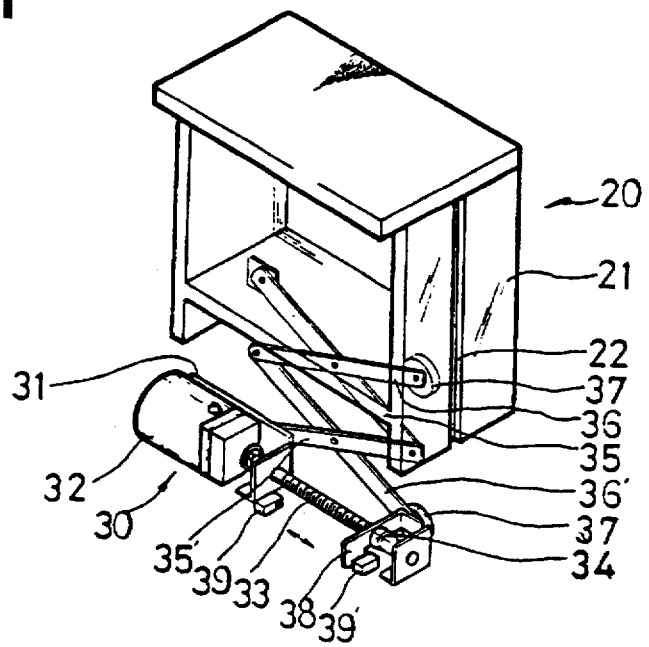
FIG. 1 is a perspective view showing the construction of a liftable monitor case with a motor-driven pantographic link work in accordance with a primary embodiment of the present invention.
Figure 2:
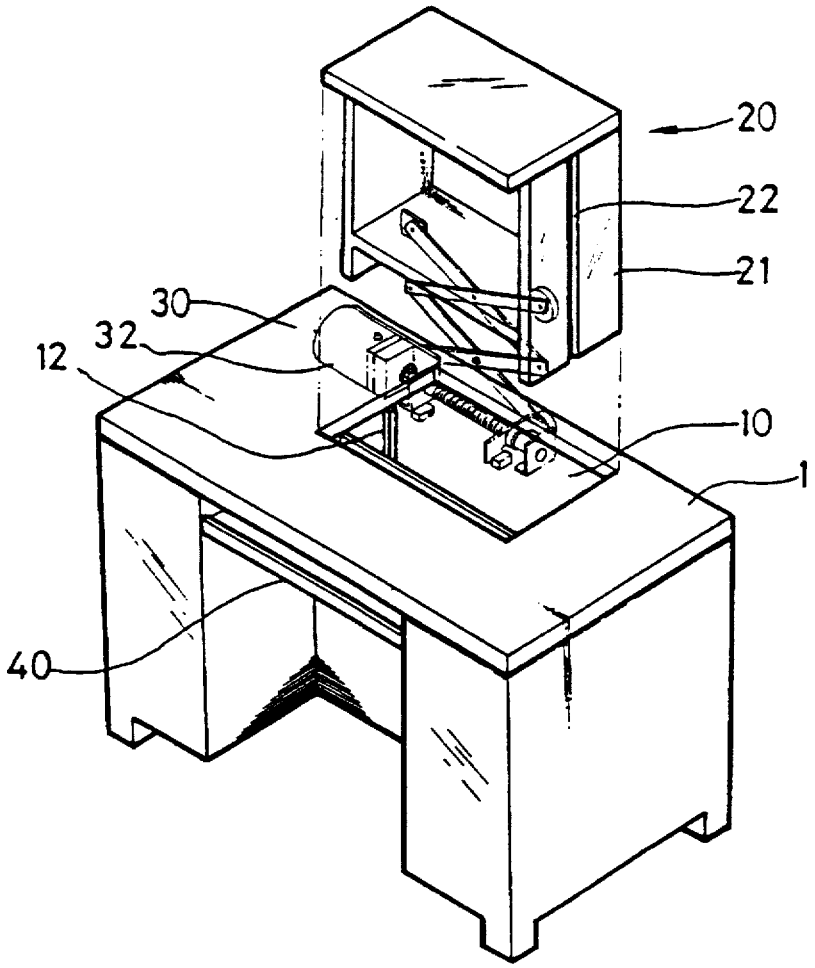
FIG. 2 is an exploded perspective view of a desk with the liftable monitor case of FIG. 1.
Figure 3:
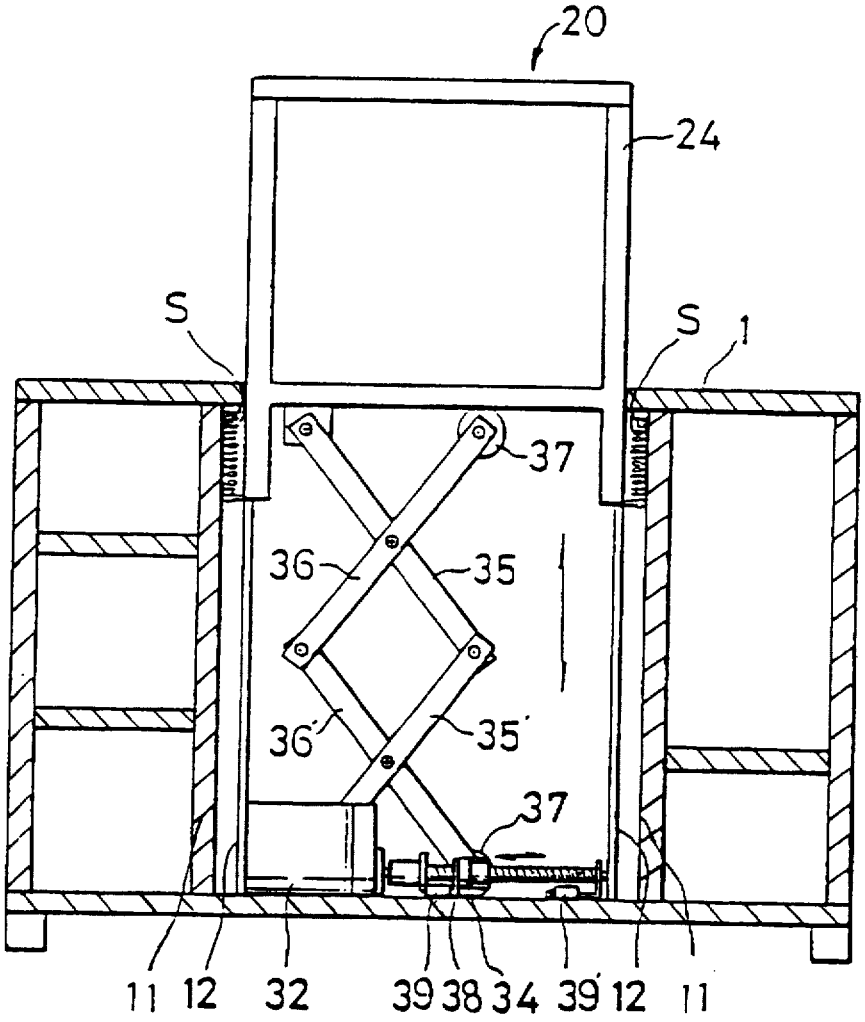
FIG. 3 is a front sectional view of the desk with the liftable monitor case of FIG. 1 in the monitor visible position or fully projected position.

FIG. 1 is a perspective view showing the construction of a liftable monitor case with a motor-driven pantographic link work in accordance with a primary embodiment of this invention. FIG. 2 is an exploded perspective view of a desk with the monitor case of FIG. 1. FIG. 3 is a front sectional view of the desk with the above monitor case.

As shown in the FIGS. 1 to 3, a monitor case compartment 10 is defined inside the desk. The compartment 10 opens through the top panel 1 of the desk through a rectangular opening formed in the top panel 1. A liftable monitor case 20 is received in the compartment 10. The above case 20 selectively moves in a vertical direction relative to the compartment 10 between the monitor visible and nonvisible positions. In order to guide the vertical movement of the case 20 relative to the compartment 10, a guide rail 12 vertically extends on each side wall 11 of the compartment 10, while a vertical guide groove 22 is vertically formed on each side wall 21 of the case 20. The grooves 22 of the case 20 engage with the guide rails 12 of the compartment 10, respectively, thus guiding the case 20 while the case 20 moves in the vertical direction relative to the compartment 10. A biasing means or tension coil spring "s" is connected to the bottom surface of the top panel 1 of the desk at a position near the opening of the compartment 10 and the lower edge of each side wall 21 of the monitor case 20. The above spring "s" additionally supports the monitor case 20, thus reducing the weight of the case 20 while the case 20 vertically moves and thereby causing the case 20 to be lifted up more easily.

Figure 4:
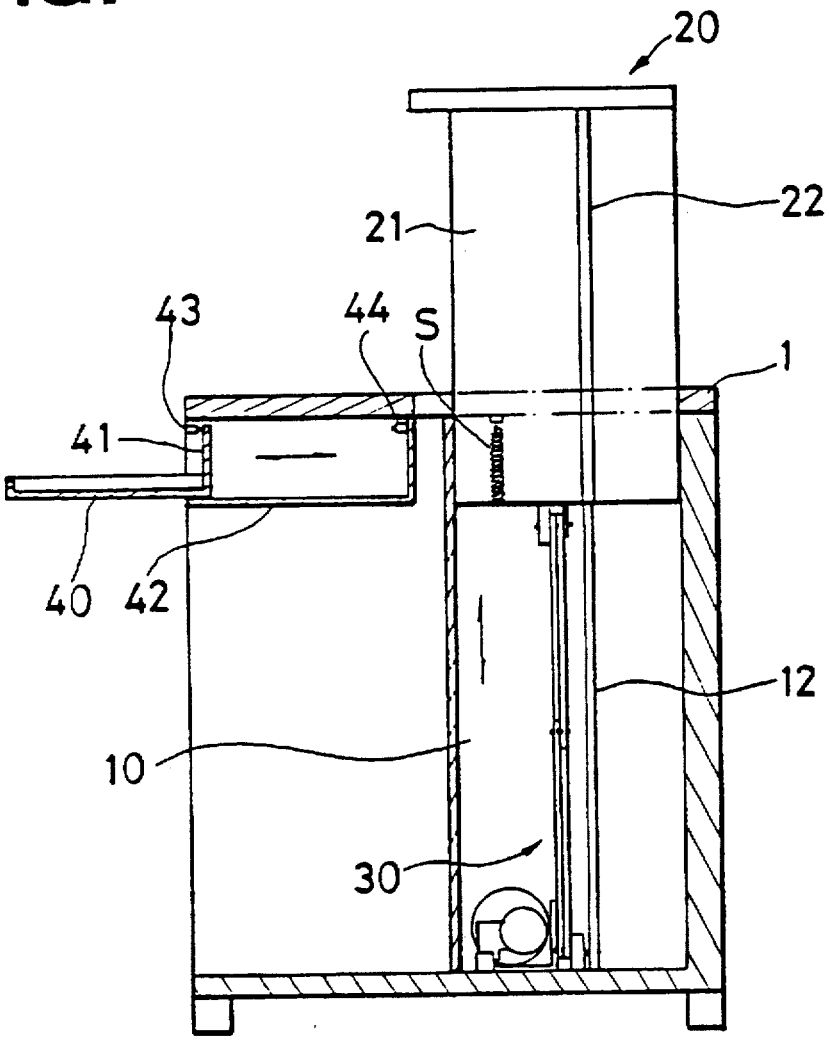
FIG. 4 is a side sectional view of the desk with the liftable monitor case of FIG. 1 in the monitor visible position or fully projected position.

The above monitor case 20 is automatically lifted up by a monitor case lifting means. The monitor case lifting means is provided under the monitor case 20. In the above monitor case lifting means, a reversible motor 32 is mounted to a motor bracket 31. This bracket 31 is fixed to the bottom of the compartment 10. A screw shaft 33 as the output shaft of the motor 32 horizontally extends from the motor 32 to a length. The above shaft 33 is movably held by a pair of shaft holders and rotates in either direction by the rotating force of the reversible motor 32. The monitor case lifting means also includes a movable nut 34. This nut 34 engages with the screw shaft 33 and horizontally reciprocates along the shaft 33 while the shaft 33 rotates in opposite directions. A pair of spaced limit switches or first and second limit switches 39 and 39' are mounted to the bottom of the compartment 10. Fitted over the screw shaft 33 inside the movable nut 34 is a movable contact bracket 38. While the screw shaft 33 rotates in opposite directions by the rotating force of the motor 32, the above contact bracket 38 horizontally reciprocates along with the nut 34 between two positions where the bracket 38 comes into contact with the limit switches 39 and 39', respectively. When the bracket 38 comes into contact with either limit switch 39, 39', the above contact bracket 38 stops the motor 32 and stops the case 20 in the monitor visible or nonvisible position. The monitor case lifting means further includes a motor-driven pantographic link work 30 consisting of four rigid arms 35, 35', 36 and 36' linked together in a parallelogram form. The above link work 30 selectively lifts up the monitor case 20 in accordance with the reciprocating motion of the contact bracket 38. In the link work 30, one upper arm 35 is hinged to the bottom of the case 20, while one lower arm 35' is hinged to the motor bracket 31. On the other hand, the other upper arm 36 has a roller 37 rolling on the bottom of the case 20, while the other lower arm 36' is hinged to the contact bracket 38. The lower arm 36' also has a roller 37 rolling on the bottom of the compartment 10. The monitor case lifting means 30 also includes a means for automatically starting the reversible motor 32 to vertically move the monitor case 20. The above motor starting means comprises a contact 41 which is provided on a keyboard drawer 40 of the desk as shown in FIG. 4. In order to cooperate with the above contact 41, third and fourth limit switches 43 and 44 are provided in a drawer receiving cavity 42 inside the desk.

The operational effect of the above desk with the liftable monitor case 20 will be described hereinbelow.

Figure 5:
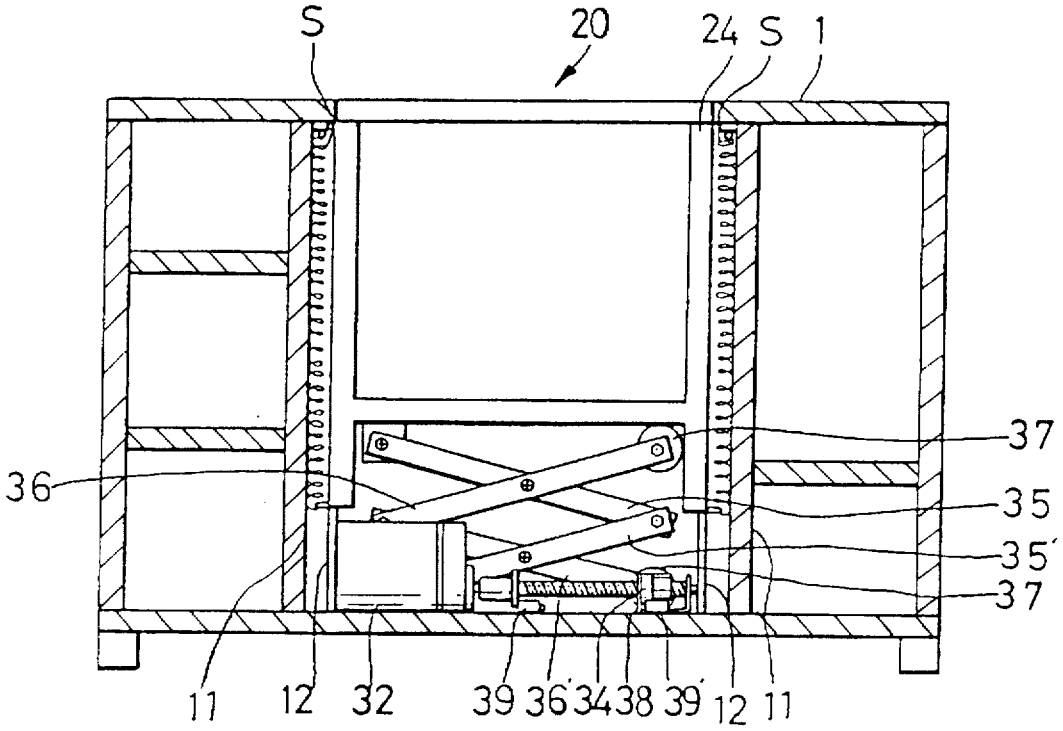
FIG. 5 is a front sectional view of the desk with the liftable monitor case of FIG. 1 in the monitor nonvisible position or fully retracted position.

When the keyboard drawer 40 fully retracts into the cavity 42 as shown in FIG. 5, the monitor case 20 is placed in the monitor nonvisible position. In the above state, the top surface of the case 20 is completely leveled with the top panel 1 of the desk, so that the desk may be used as a reading desk.

When the drawer 40 is fully drawn out as shown in FIG. 4, the contact 41 of the drawer 40 is brought into contact with the third limit switch 43, thus turning on the switch 43. In the above state, the reversible motor 32 starts in a normal direction and rotates the screw shaft 33 in the normal direction. While the screw shaft 33 is rotated in the normal direction, the movable nut 34 together with the contact bracket 38 moves toward the motor 32 under the guide of the screw shaft 33.

The hinged end of the lower arm 36' in the above state is pulled toward the motor 32, thus extending the pantographic link work 30 and thereby lifting up the monitor case 20.

When the monitor case 20 has been fully lifted up, the contact bracket 38 comes into contact with the first limit switch 39 and thereby turns off the motor 32. The monitor case 20 thus remains in the monitor visible position. The desk in the above state may be used as a computer desk.

When the drawer 40 is fully closed into the cavity 42 after using the computer system, the contact 41 of the drawer 40 comes into contact with the fourth limit switch 44 inside the cavity 42, thus turning on the switch 44. In the above state, the reversible motor 32 starts in a reverse direction and rotates the screw shaft 33 in the reverse direction. While the screw shaft 33 is rotated in the reverse direction, the movable nut 34 together with the contact bracket 38 moves away from the motor 32. The hinged end of the lower arm 36' in the above state is pushed away from the motor 32, thus retracting the pantographic link work 30 and thereby lowering the monitor case 20.

When the monitor case 20 has been fully lowered to level the top surface thereof with the top panel 1 of the desk, the contact bracket 38 comes into contact with the second limit switch 39' and thereby turns off the motor 32. The monitor case 20 thus remains in the monitor nonvisible position. The desk in the above state may be used as a reading desk.

While the monitor case 20 reciprocates in the vertical direction relative to the compartment 10 as described above, the case 20 is stably and smoothly guided by the guide rails 12 of the compartment 10 engaging with the guide grooves 22 of the case 20. During the vertical movement of the monitor case 20, the tension coil springs "s" bias the case 20 upward, thus reducing the weight of the case 20. In this regard, the springs "s" prevent the motor 32 from overload while the case 20 vertically moves.

Figure 6:
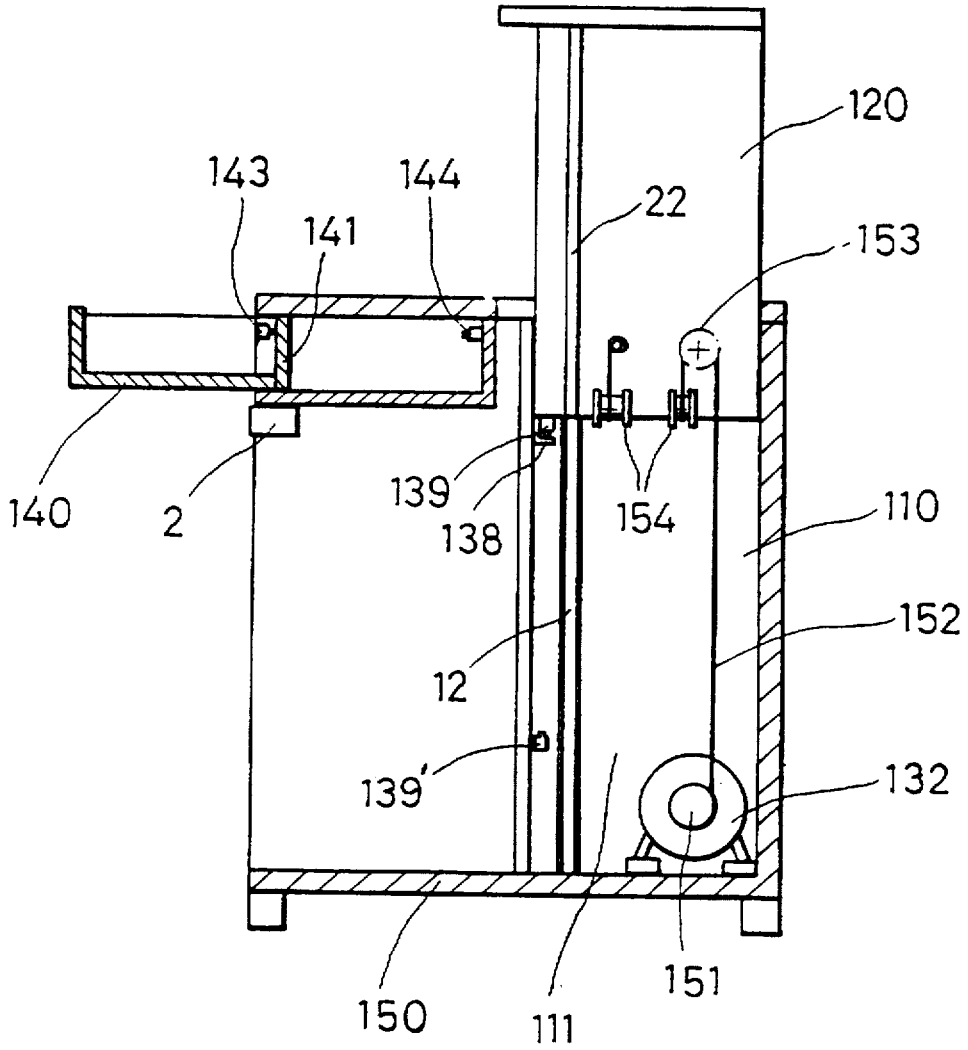
FIG. 6 is a side sectional view of a desk with a liftable monitor case according to a second embodiment of the present invention, the monitor case being in the monitor visible position or fully projected position.
Figure 7:
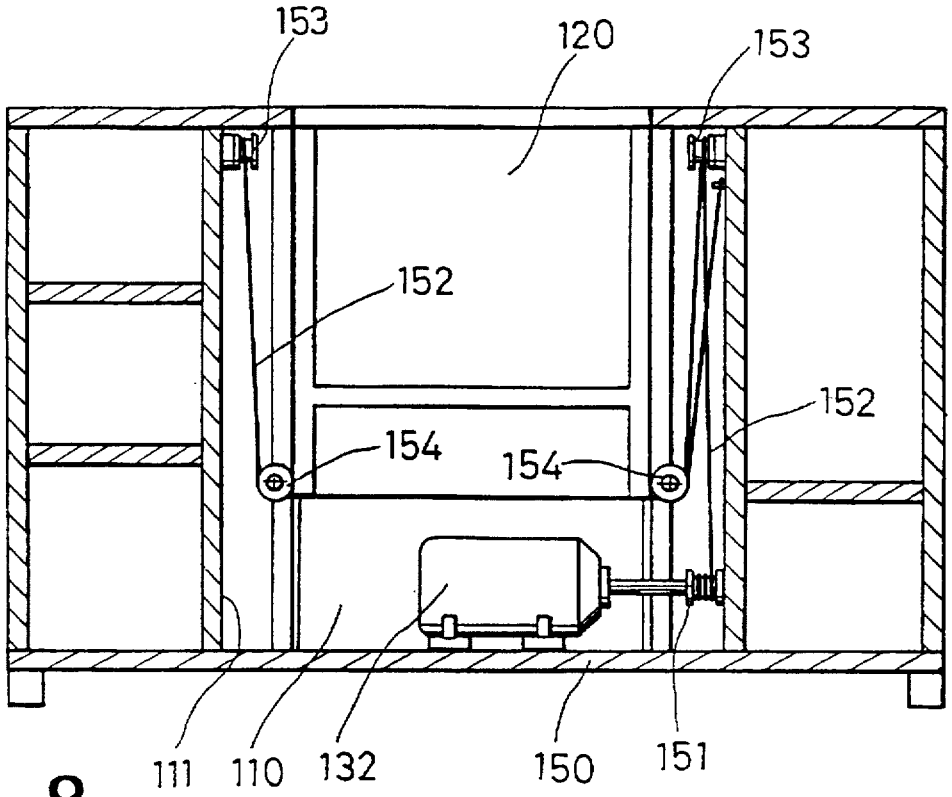
FIG. 7 is a front sectional view of the desk with the liftable monitor case of FIG. 6 in the monitor nonvisible position or fully retracted position.
Figure 8:
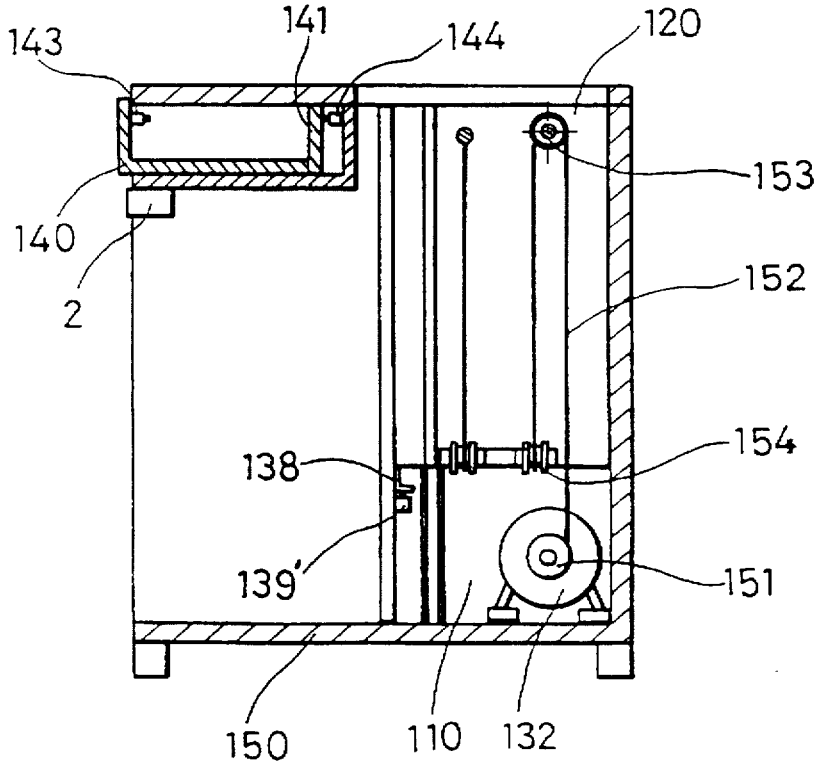
FIG. 8 is a side sectional view of the desk of FIG. 7.

FIGS. 6 to 8 show a desk with a liftable monitor case according to a second embodiment of the present invention. In this embodiment, the monitor case lifting means comprises a pulley block.

As shown in FIGS. 6 to 8, the reversible motor 132 is mounted to the bottom panel 150 of the desk. The take-up drum 151 of the pulley block of this embodiment is mounted to the output shaft of the above motor 132. The pulley block also includes two static pulleys 153, which are mounted to the top of both side walls 111 of the compartment 110. The pulley block further includes two pairs of dynamic pulleys 154. Each pair of dynamic pulleys 154 are mounted to each bottom side of the monitor case 120. The power transmission rope 152 of the above pulley block extends from the fixing point provided on the upper portion of one side wall 111 of the compartment 110. The rope 152 passes over the static pulleys 153 and dynamic pulleys 154 and in turn is connected to the take-up drum 151. The take-up drum 151 winds or unwinds the rope 152 in accordance with the reversible rotation of the motor 132 so that the monitor case 120 is fully projected or retracted from or into the desk.

A contact bracket 138 is mounted to the outer bottom surface of the monitor case 120, while first and second limit switches 139 and 139' are mounted to either side wall 111 of the compartment 110 at appropriate upper and lower positions, respectively. The above contact bracket 138 is selectively brought into contact with either switch 139 or 139' while vertically reciprocating inside the compartment 110, thus stopping the reversible motor 132.

In operation of the above embodiment of FIGS. 6 to 8, the contact 141 of the drawer 140 is brought into contact with the third limit switch 143 when the drawer 40 is fully drawn out, thus turning on the third limit switch 143 in the same manner as described for the primary embodiment. In the above state, the reversible motor 132 starts in a normal direction and rotates the take-up drum 151 in the normal direction. Therefore, the rope 152 is wound about the take-up drum 151 and is stretched so that the dynamic pulleys 154 along with the monitor case 120 are lifted upward. The monitor case 120 is thus projected from the compartment 110 as shown in FIG. 6. When the monitor case 120 has been fully lifted up, the contact bracket 138 comes into contact with the first limit switch 139 and thereby turns off the motor 132. The monitor case 120 thus remains in the monitor visible position. The desk in the above state may be used as a computer desk.

Figure 9:
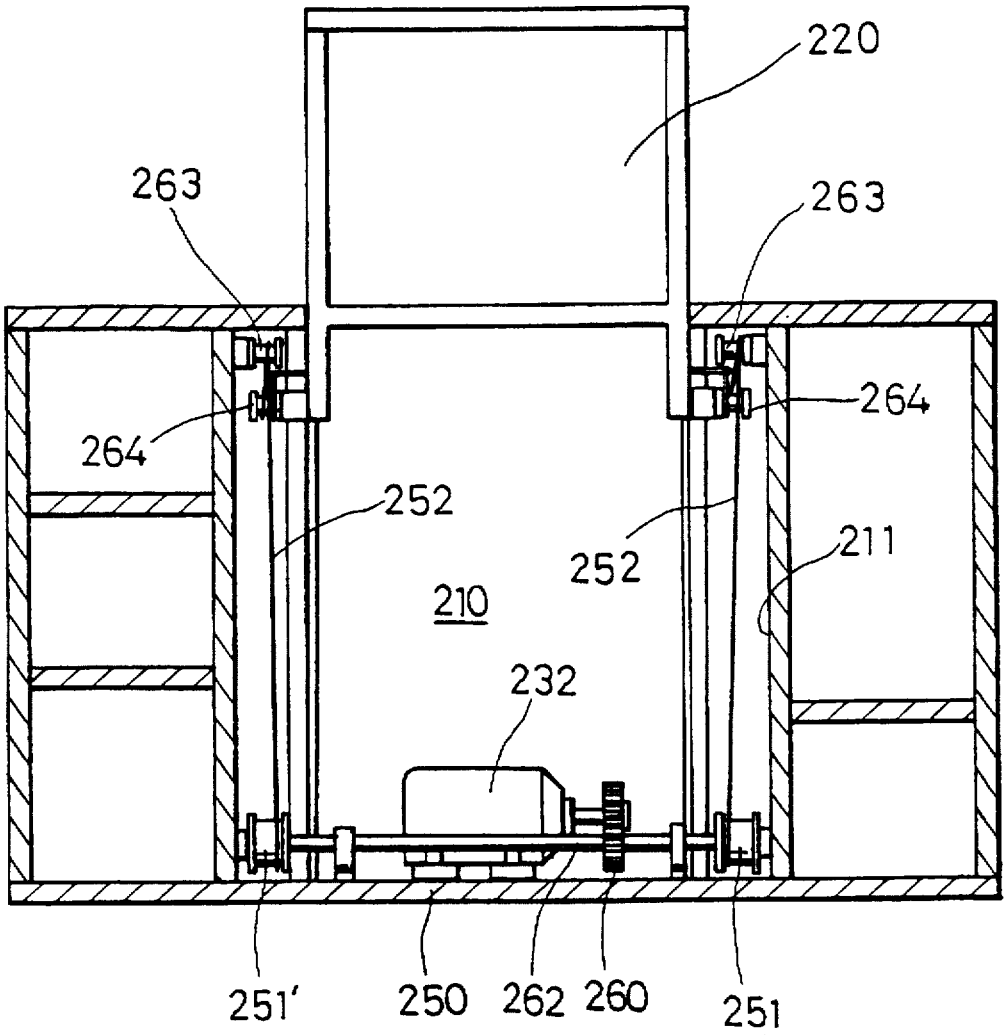
FIG. 9 is a front sectional view of a desk with a liftable monitor case according to a third embodiment of the present invention, the monitor case being in the monitor visible position or fully projected position.
Figure 10:
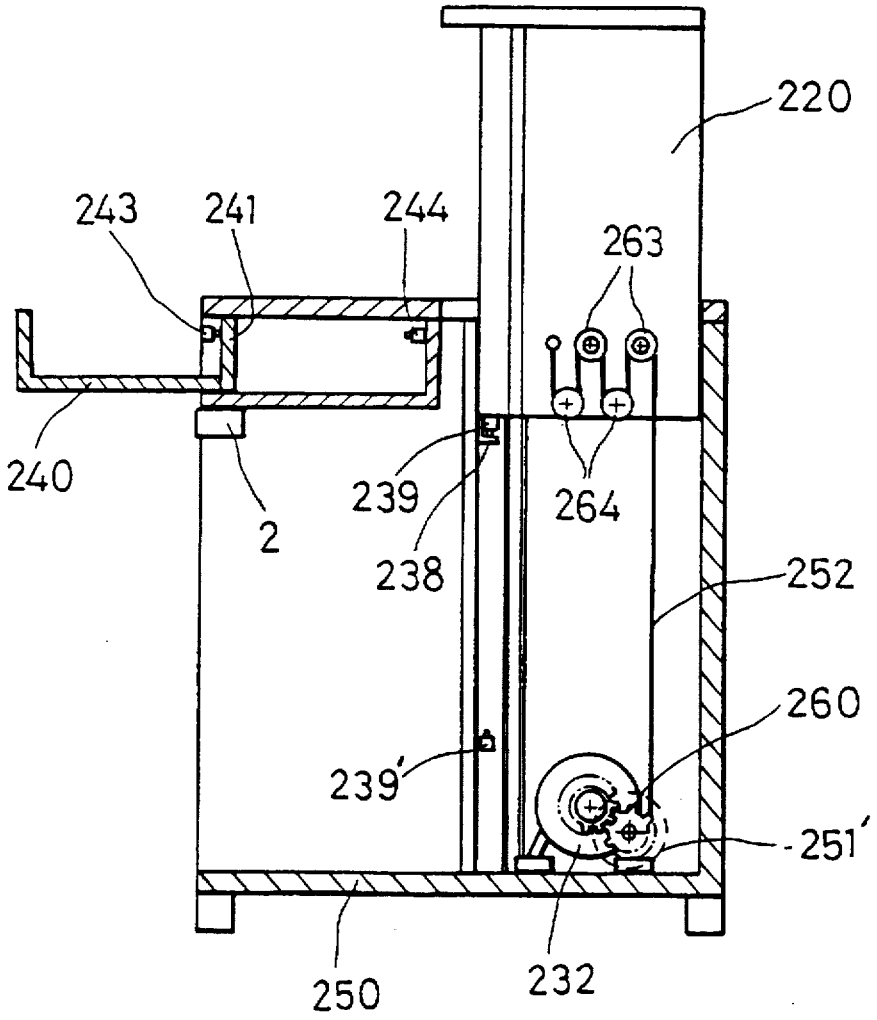
FIG. 10 is a side sectional view of the desk of FIG. 9.

FIGS. 9 and 10 show a desk with a liftable monitor case according to a third embodiment of the present invention. In this embodiment, the monitor case lifting means comprises two pulley blocks.

As shown in FIGS. 9 and 10, the reversible motor 232 is mounted to the bottom panel 250 of the desk. A longitudinal driven shaft 262 horizontally extends on the bottom panel 250 and is transmitted with the rotating force of the output shaft of the motor 232 through differential gears 260. Two take-up drums 251 and 251' are mounted to both ends of the above driven shaft 262. Each pulley block of this embodiment includes two static pulleys 263, which are mounted to the top of each side wall 211 of the compartment 210 in a similar manner as described for the second embodiment. Each pulley block further includes two dynamic pulleys 264, which are mounted to each bottom side of the monitor case 220. In each pulley block, a power transmission rope 252 extends from the fixing point provided on the lower portion of each side wall of the monitor case 220. The rope 252 in turn passes over the static pulleys 263 of each side wall 211 of the compartment 210 and the dynamic pulleys 264 of each side wall of the monitor case 220 and in turn is connected to each take-up drum 251 or 251'.

The take-up drums 251 and 251' wind or unwind the ropes 252 in accordance with the reversible rotation of the motor 232 so that the dynamic pulleys 264 along with the monitor case 220 move in a vertical direction. The monitor case 220 is thus fully projected or retracted from or into the desk.

In the same manner as described for the second embodiment, a contact bracket 238 is mounted to the outer bottom surface of the monitor case 220, while first and second limit switches 239 and 239' are mounted to either side wall 211 of the compartment 210 at appropriate upper and lower positions, respectively. The above contact bracket 238 is selectively brought into contact with either switch 239 or 239' while vertically reciprocating inside the compartment 210, thus stopping the reversible motor 232.

In operation of the above embodiment of FIGS. 9 and 10, the contact 241 of the drawer 240 is brought into contact with the third limit switch 243 when the drawer 240 is fully drawn out, thus turning on the limit switch 243 in the same manner as described for the primary embodiment. In the above state, the reversible motor 232 starts in a normal direction and transmits the rotating force to the driven shaft 262 through the differential gears 260 so that the driven shaft 262 with the take-up drums 251 and 251' is rotated in a normal direction.

Therefore, the ropes 252 are wound about the respective take-up drums 251 and 251' and are stretched so that the dynamic pulleys 264 along with the monitor case 220 are lifted upward. The monitor case 220 is thus fully projected from the compartment 210 as shown in FIG. 9 and remains in the monitor visible position. When the monitor case 220 has been fully lifted up, the contact bracket 238 comes into contact with the first limit switch 239 and thereby turns off the motor 232.

The desk in the above state may be used as a computer desk.

When the drawer 240 is fully closed into the drawer cavity after using the computer system, the contact 241 of the drawer 240 comes into contact with the fourth limit switch 244 inside the cavity, thus turning on the limit switch 244 in the same manner as described for the primary embodiment. In the above state, the reversible motor 232 starts in a reverse direction and rotates the take-up drums 251 and 251' in the reverse direction. The take-up drums 251 and 251' thus unwind the ropes 252 so that the dynamic pulleys 264 along with the monitor case 220 are lowered. The monitor case 220 is thus retracted into the compartment 210. When the monitor case 220 has been fully lowered to level the top surface thereof with the top panel of the desk, the contact bracket 238 comes into contact with the second limit switch 239' and thereby turns off the motor 232. The monitor case 220 thus remains in the monitor nonvisible position. The desk in the above state may be used as a reading desk.

In the above second and third embodiments, the reversible motor is provided with a brake which prevents a sudden movement of the monitor case while using the desk as a computer or reading desk. In addition, a locking device 2 for the drawer is mounted to the drawer part of the desk so that the drawer is opened only by authorized personnel with a key. Due to the locking device, the computer system cannot be operated by unauthorized persons so that the data stored in the computer system is almost completely protected from the unauthorized persons.

In the above description, the liftable case of this invention is used with a desk, for example. However, it should be understood that the liftable case of this invention may be used with another furniture for selectively lifting another type of electronic instrument such as a TV set or stereo system. In addition, the pantographic link work in the case lifting means according to the primary embodiment may be substituted with a conventional hydraulic jack or chain and sprockets.

As described above, the present invention provides a desk with a liftable monitor case. The above monitor case is movably received inside a monitor case compartment defined in the desk. The monitor case selectively moves in a vertical direction relative to the compartment between monitor visible and nonvisible positions. In the monitor nonvisible position, the top surface of the case is completely leveled with the top panel of the desk, so that the desk in the above state may be used as a reading desk. On the other hand, the desk in the monitor visible position may be used as a computer desk. That is, the desk with the liftable monitor case of this invention may be selectively used as a reading or computer desk as desired. The desk of this invention thus removes necessity of separate equipment of reading and computer desks in the home or office, so that the desk improves spatial efficiency and saves money.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A desk comprising:

a monitor case compartment defined in said desk and opening outside a top panel of said desk through an opening formed on said top panel, said compartment being provided with a pair of guide rails vertically extending on both side walls thereof, respectively;

a liftable monitor case received in said compartment to vertically move between monitor-visible and nonvisible positions, each side wall of said case having a guide groove engaging with an associated guide rail of said compartment to guide said case while the case vertically moves relative to the compartment;

means for selectively lifting said monitor case relative to the compartment; and means for automatically starting said monitor case lifting means to vertically move said monitor case between the monitor-visible and nonvisible positions, wherein said starting means includes:

a contact provided on a keyboard drawer in said desk;

third and fourth limit switches provided in a drawer-receiving cavity inside the desk, said third or fourth limit switch being selectively brought into contact with said contact of the drawer in fully-drawn or fully-retracting position, thus starting said monitor case lifting means in either direction.

2. The desk according to claim 1, wherein said lifting means comprises:

a reversible motor mounted to a motor bracket fixed to the bottom of said compartment;

a screw shaft horizontally extending from said motor to a predetermined length and held by a pair of shaft holders, said shaft being rotated by the rotating force of the motor;

a movable nut engaging with said screw shaft and horizontally reciprocating along said screw shaft by a rotating force of the shaft;

first and second limit switches mounted to the bottom of said compartment with an interval between said switches;

a contact bracket movably fitted over said screw shaft inside the movable nut and horizontally reciprocating along said screw shaft between two positions where the contact bracket comes into contact with said limit switches, respectively, said contact bracket stopping said motor when the bracket comes into contact with either limit switch; and a pantographic link work consisting of four rigid arms linked together in a parallelogram form and adapted for selectively lifting up said monitor case in accordance with a reciprocating motion of said contact bracket, one upper arm of said link work being hinged to the bottom of said case, one lower arm being hinged to said motor bracket, the other upper arm having a roller rolling on the bottom of said case, and the other lower arm being hinged to said contact bracket and having a roller rolling on the bottom of said compartment.

3. The desk according to claim 1, wherein said lifting means comprises:

a reversible motor mounted to a bottom panel of the desk;

a take-up drum mounted to the output shaft of said motor; and a pulley block including:

two static pulleys mounted to the top of both side walls of said monitor case compartment, respectively;

two dynamic pulleys mounted to each bottom side of said monitor case; and a rope extending from a fixing point of one side wall of said compartment and passing over the static and dynamic pulleys and in turn being connected to said take-up drum so that the rope is wound or unwound on or from the take-up drum in accordance with a reversible rotation of said motor thus moving the monitor case in a vertical direction.

4. The desk according to claim 1, wherein said lifting means comprises:

a reversible motor mounted to a bottom panel of the desk;

a driven shaft horizontally extending on said bottom panel and being transmitted with the rotating force of said motor through differential gears;

two take-up drums mounted to both ends of said driven shaft; and two pulley blocks, each of said pulley blocks including:

two static pulleys mounted to the top of each side wall of said monitor case compartment;

two dynamic pulleys mounted to each bottom side of said monitor case; and a rope extending from a fixing point provided on each side wall of said monitor case and alternately passing over the dynamic and static pulleys and in turn being connected to each take-up drum so that the rope is wound or unwound on or from the take-up drum in accordance with a reversible rotation of said motor thus moving the monitor case in a vertical direction.

5. The desk according to claim 1, further comprising means for biasing said monitor case upward to reduce the weight of the case and thereby cause said case to be lifted more easily, said biasing means connected to the bottom surface of said top panel of the desk at a position near said opening and a lower edge of each side wall of said monitor case.

* * * * *